US005171466A

United States Patent [19]

Korosec

[11] Patent Number: 5,171,466

[45] Date of Patent: Dec. 15, 1992

[54] SUCCINIMIDE COMPOSITIONS

[75] Inventor: Philip S. Korosec, Baton Rouge, La.

[73] Assignee: Ethyl Petroleum Additives Limited, Bracknell, England

[21] Appl. No.: 688,026

[22] Filed: Apr. 19, 1991

[51] Int. Cl.[5] ..... C10M 133/44

[52] U.S. Cl. ..... 252/51.5 A; 252/51.5 R

[58] Field of Search ..... 252/51.5 A, 51.5 R

[56] References Cited

U.S. PATENT DOCUMENTS

| | | | |
|---|---|---|---|
| 3,024,195 | 3/1962 | Drummond et al. | 252/51.5 |
| 3,024,237 | 3/1962 | Drummond et al. | 260/268 |
| 3,194,812 | 7/1965 | Norman et al. | 260/326.5 |
| 3,200,076 | 8/1965 | Anderson et al. | 252/51.5 |
| 3,219,666 | 11/1965 | Norman et al. | 260/268 |
| 3,312,619 | 4/1967 | Vineyard | 252/47.5 |
| 4,234,435 | 11/1980 | Meinhardt et al. | 252/46.6 |
| 4,663,064 | 5/1987 | Nalesnik et al. | 252/51.5 A |
| 4,686,054 | 8/1987 | Wisotsky et al. | 252/32.7 E |
| 4,713,190 | 12/1987 | Erdman | 252/51.5 A |
| 4,747,965 | 5/1988 | Wollenberg et al. | 252/51.5 A |
| 4,839,073 | 7/1989 | Gutierrez et al. | 252/51.5 A |
| 4,840,744 | 1/1989 | Wollenberg et al. | 252/51.5 A |
| 4,857,214 | 8/1989 | Papay et al. | 252/32.5 |
| 4,863,487 | 9/1989 | Meyer et al. | 44/63 |

FOREIGN PATENT DOCUMENTS

| | | |
|---|---|---|
| 0136185 | 4/1985 | European Pat. Off. . |
| 0271937 | 6/1988 | European Pat. Off. . |
| 1087039 | 10/1967 | United Kingdom . |

*Primary Examiner*—Olik Chaudhuri
*Assistant Examiner*—M. Nuzzolillo
*Attorney, Agent, or Firm*—John F. Sieberth

[57] ABSTRACT

Oil-soluble dispersants are formed by reacting (i) at least one aliphatic hydrocarbyl substituted succinic acylating agent in which the hydrocarbyl substituent contains an average of at least 40 carbon atoms with (ii) a mixture consisting essentially of hydrocarbyl polyamines containing from 10 to 50 weight percent acyclic alkylene polyamines and 50 to 90 weight percent cyclic alkylene polyamines. Such dispersants exhibit improved compatibility with fluoroelastomers as compared to succinimides formed from conventional alkylene polyamine mixtures predominating in acyclic isomers.

22 Claims, No Drawings

SUCCINIMIDE COMPOSITIONS

This invention relates to succinimide dispersants and to compositions containing them. More particularly, this invention relates to aliphatic succinimides and aliphatic succinimide-containing compositions of enhanced performance capabilities.

A continuing problem in the art of lubrication is to provide lubricant compositions which satisfy the demands imposed upon them by the original equipment manufacturers. One such requirement is that the lubricant not contribute to premature deterioration of seals, clutch face plates or other parts made from fluoroelastomers. Unfortunately, and as is well known, succinimide dispersants commonly used in oils tend to exhibit a strong adverse effect upon fluoroelastomers, by causing them to lose their flexibility and tensile strength, to become embrittled, and in severe cases, to disintegrate. It has been postulated that the co-presence of zinc-containing additives such as zinc dialkyldithiophosphates tends to increase the severity of this problem. Contemporary test methods for evaluating fluoroelastomer compatibility of lubricant compositions are the Volkswagen P.VW 3334 Seal Test and the CCMC Viton Seal Test (CEL L-39-T-87 Oil/Elastomer Compatibility Test). A new, effective, practical way of overcoming this adverse property of succinimide dispersants would be a welcome contribution to the art.

Heretofore substantial efforts have been devoted to developing post-treating processes for chemically modifying succinimide dispersants in a beneficial manner. While such procedures are useful, they do add to the complexity of the processing involved in the manufacture of the dispersants.

The present invention involves the discovery of ways of providing oil-soluble dispersants which can be manufactured without need for post-treatment and which nonetheless exhibit good compatibility with fluoroelastomers commonly employed as seals or the like. Indeed, pursuant to preferred embodiments of this invention, virtually no change in conventional dispersant manufacturing processes are involved.

In accordance with this invention, the foregoing improvements are effected by utilizing in the manufacture of the dispersants mixtures of hydrocarbyl polyamines containing appropriate proportions of acyclic alkylene polyamines and cyclic alkylene polyamines. More particularly, this invention provides in one of its embodiments, an oil-soluble dispersant composition formed by reacting (i) at least one aliphatic hydrocarbyl substituted succinic acylating agent in which the hydrocarbyl substituent contains an average of at least 40 carbon atoms with (ii) a mixture consisting essentially of hydrocarbyl polyamines containing from 10 to 50 weight percent acyclic polyalkylene polyamines and 50 to 90 weight percent cyclic polyalkylene polyamines.

Prior work on the development of succinimide dispersants based on use of cyclic amines is exemplified by the following representative patents:

U.S. Pat. Nos. 3,024,195 and 3,024,237 describe N-(2-aminoalkyl)piperazine monoalkenyl succinimides and their use as lubricating oil detergents.

U.S. Pat. No. 3,194,812 describes high molecular weight alkenyl-N-para-aminophenyl succinimides and their use as detergents in lubricating oils.

U.S. Pat. No. 3,200,076 discloses polypiperazinyl succinimides and their use as detergents in lubricating oils.

U.S. Pat. No. 3,219,666 deals with succinimide lubricant additives made from ammonia, aliphatic amines, aromatic amines, heterocyclic amines or carbocyclic amines. The amines may be primary or secondary amines and may also be polyamines such as alkylene amines, arylene amines, cyclic polyamines, and the hydroxy-substituted derivatives of such polyamines. In Example 5, reference is made to an ethylene amine mixture having an average composition corresponding to tetraethylene pentamine identified by the trade name "Polyamine H". Example 80 refers to a commercial mixture of alkylene amines and hydroxy alkyl-substituted alkylene amines consisting of approximately 2% (by weight) of diethylene triamine, 36% of 1-(2-aminoethyl)piperazine, 11% of 1-(2-hydroxyethyl)piperazine, 11% of N-(2-hydroxyethyl)ethylenediamine, and 40% of higher homologues obtained as a result of condensation of such amine components.

U.S. Pat. No. 3,312,619 describes succinimide-imidazolidines and their use as lubricant additives.

U.S. Pat. No. 4,234,435 contains an extensive discussion of succinimide dispersants made from amines containing at least one H-N> group. Commercial mixtures of ethylene polyamines corresponding to the empirical formulas of diethylene triamine, of triethylene tetramine, and of pentaethylene hexamine, as well as a commercial mixture of ethylene polyamines having from about 3 to 10 nitrogen atoms per molecule are mentioned in the examples. Also used in the examples are a number of individual amines.

U.S. Pat. No. 4,686,054 refers to use in the production of succinimides of a commercial mixture of ethylene polyamines which approximates tetraethylene pentamine. Such mixture is identified as E-100.

U.S. Pat. No. 4,863,487 describes fuel detergents made from $C_{8-30}$ alkenyl succinic acid or anhydride and mixtures of aliphatic and heterocyclic polyamines composed by weight of 5 to 70% aminoethylethanolamine, 5 to 30% aminoethylpiperazine, 0 to 25% triethylene tetramine, 0 to 20% hydroxyethylpiperazine, 0 to 10% diethylene triamine and 10 to 85% higher oligomers of such amines.

None of the foregoing patents is concerned with fluoroelastomer compatibility let alone use of the particular types of mixtures utilizes in the practice of this invention.

Unlike conventional oil soluble succinimide dispersants such as are produced from commercially available mixtures of alkylene polyamines, e.g., mixtures approximating triethylene tetramine or tetraethylene pentamine, the oil-soluble succinimide dispersants produced in accordance with this invention exhibit improved compatibility with fluoroelastomers. In accordance with preferred embodiments, succinimide dispersants provided by this invention are capable of providing lubricant formulations which satisfy the requirements of the Volkswagen P.VW 3334 seal Test.

As used herein the term "succinimide" is meant to encompass the completed reaction product from reaction between components (i) and (ii) and is intended to encompass compounds wherein the product may have amide, amidine, and/or salt linkages in addition to the imide linkage of the type that results from the reaction of a primary amino group and an anhydride moiety.

In another of its embodiments, this invention provides lubricant, functional fluid and additive concentrate compositions containing the oil soluble dispersant compositions of this invention.

Still other embodiments of this invention relate to the provision of methods of lubricating mechanical parts with a lubricating oil containing a dispersant in the presence of at least one fluoroelastomer surface. Such methods are characterized in that the lubrication is performed with a lubricating oil containing an oil-soluble dispersant of this invention.

Yet another embodiment of this invention is the combination of a mechanical mechanism containing moving parts to be lubricated, a lubricating oil composition for lubricating such parts, and a polyfluoroelastomer in contact with at least a portion of such lubricating oil composition, characterized in that the lubricating oil composition for effecting such lubrication contains an oil-soluble dispersant of this invention.

A further embodiment of this invention provides a process for the production of the oil-soluble dispersants of the type described herein.

Other embodiments of this invention involve the post-treatment of the oil-soluble dispersants of this invention by reacting such dispersants with at least one post-treating agent selected from the group consisting of boron oxide, boron oxide hydrate, boron halides, boron acids, esters of boron acids, carbon disulphide, hydrogen sulphide, sulphur, sulphur chloride, alkenyl cyanides, carboxylic acid acylating agents, aldehyde, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulphides, phosphorus oxides, phosphoric acid, phosphorous acid, hydrocarbyl thiocyanates, hydrocarbyl isocyanates, hydrocarbyl isothiocyanates, epoxides, episulphides, formaldehyde or formaldehyde producing compounds plus phenols, and sulphur plus phenols.

These and other embodiments and features of this invention will be apparent from the ensuing description and appended claims.

Component (i). As noted above, the oil-soluble dispersants of this invention are formed by use as one of the reactants of at least one aliphatic hydrocarbyl substituted succinic acylating agent in which the hydrocarbyl substituent contains an average of at least 40 carbon atoms. A preferred category of such acylating agents is comprised of at least one hydrocarbyl substituted succinic acylating agent in which the substituent is principally alkyl, alkenyl, or polyethylenically unsaturated alkenyl, or any combination thereof and wherein such substituent has an average of from 50 to 5000 carbon atoms. Particularly preferred for use as the acylating agent is (a) at least one polyisobutenyl substituted succinic acid or (b) at least one polyisobutenyl substituted succinic anhydride or (c) a combination of at least one polyisobutenyl substituted succinic acid and at least one polyisobutenyl substituted succinic anhydride in which the polyisobutenyl substituent in (a), (b) or (c) is derived from polyisobutene having a number average molecular weight in the range of 700 to 5,000.

As is well known, the substituted succinic acylating agents are those which can be characterized by the presence within their structure of two groups or moieties. The first group or moiety is a substituent group derived from a polyalkene. The polyalkene from which the substituted groups are derived is characterized by an $\overline{M}n$ (number average molecular weight) value of from about 500 to about 10,000, and preferably in the range of from about 700 to about 5,000.

The second group or moiety is the succinic group, a group characterized by the structure

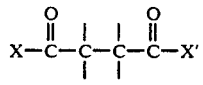

Formula I wherein X and X' are the same or different provided at least one of X and X' is such that the substituted succinic acylating agent can function as a carboxylic acylating agent. In other words, at least one of X and X' must be such that the substituted acylating agent can esterify alcohols, form amides or amine salts with ammonia or amines, form metal salts with reactive metals or basically reacting metal compounds, and otherwise functions as a conventional carboxylic acid acylating agent. Transesterification and transamidation reactions are considered, for purposes of this invention, as conventional acylation reactions.

Thus, X and/or X' is usually —OH, —O-hydrocarbyl; $—O^-M^+$ where $M^+$ represents one equivalent of a metal, ammonium or amine cation, $—NH_2$, —Cl, —Br, and together, X and X' can be —O— so as to form the one of the above is not critical so long as its presence does not prevent the remaining group from entering into acylation reactions.

Preferably, however, X and X' are each such that both carboxyl functions of the succinic group can enter into acylation reactions.

One of the unsatisfied valences in the grouping

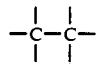

of Formula I forms a carbon-to-carbon bond with a carbon atom in the substituent group. While other such unsatisfied valence may be satisfied by a similar bond with the same or different substituent group, all but the said one such valence is usually satisfied by a hydrogen atom.

The succinic groups of the succinic acylating agents will normally correspond to the formula

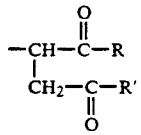

Formula II wherein R and R' are each independently selected from the group consisting of —OH, —Cl, —OR'' (R''=lower alkyl), and when taken together, R and R' are —O—. In the latter case the succinic group is a succinic anhydride group. All the succinic groups in a particular succinic acylating agent need not be the same, but they can be the same. Preferably, the succinic groups will correspond to Formula III

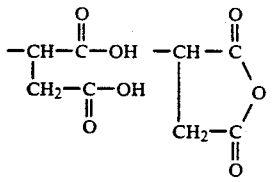

(A) (B)

and mixtures of III(A) and III(B). Production of substituted succinic acylating agents wherein the succinic groups are the same or different is within ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, the polymers used include binary copolymers, terpolymers, tetrapolymers, and the like. The polyalkenes from which the substituent groups are derived are often referred to as polyolefin(s).

The olefin monomers from which the polyalkenes are derived are polymerizable olefin monomers characterized by the presence of one or more ethylenically unsaturated groups (i.e., $>C=C<$); that is, they are monoolefinic monomers such as ethylene, propylene, 1-butene, isobutene, and 1-octene or polyolefinic monomers (usually diolefinic monomers) such as 1,3-butadiene and isoprene.

These olefin monomers are usually polymerizable terminal olefins; that is, olefins characterized by the presence in their structure of the group $>C=CH_2$. However, polymerizable internal olefin monomers characterized by the presence within their structure of the group

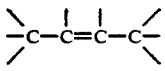

can also be used to form the polyalkenes. When internal olefin monomers are employed, they normally will be employed with terminal olefins to produce polyalkenes which are interpolymers. When a particular polymerizable olefin monomer can be classified as both a terminal olefin and an internal olefin, it is usually categorised as a terminal olefin. An example of such a monomer is 1,3-pentadiene (i.e., piperylene).

While the polyalkenes from which the substituent groups of the succinic acylating agents are derived generally are hydrocarbon polyalkenes, they can contain non-hydrocarbon groups such as lower alkoxy, lower alkyl mercapto, hydroxy, mercapto, oxo, nitro, halo, cyano, carboalkoxy (i.e.,

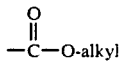

where "alkyl" is usually lower alkyl, namely an alkyl group containing up to about 7 carbon atoms), alkanoyloxy (or carbalkoxy, i.e.,

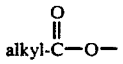

where "alkyl" is usually lower alkyl), and the like, provided the non-hydrocarbon substituents do not substantially interfere with formation of the substituted succinic acid acylating agents. When present, such non-hydrocarbon groups normally will not contribute more than about 10% by weight of the total weight of the polyalkenes. Since the polyalkene can contain such non-hydrocarbon substituents, it is apparent that the olefin monomers from which the polyalkenes are made can also contain such substituents. Normally, however, as a matter of practicality and expense, the olefin monomers and the polyalkenes used are free from non-hydrocarbon groups, except chloro groups which usually facilitate the formation of the substituted succinic acylating agents.

Although the polyalkenes may include aromatic groups (especially phenyl groups and lower alkyl- and/or lower alkoxy-substituted phenyl groups such as p-tert-butylphenyl) and cycloaliphatic groups such as would be obtained from polymerizable cyclic olefins or cycloaliphatic substituted-polymerizable acyclic olefins, the polyalkenes usually will be free from such groups. Nevertheless, polyalkenes derived from interpolymers of both 1,3-dienes and styrenes such as 1,3-butadiene and styrene or 4-tert-butyl-styrene are exceptions to this generalization. Similarly the olefin monomers rom which the polyalkenes are prepared can contain both aromatic and cycloaliphatic groups.

Generally speaking aliphatic hydrocarbon polyalkenes free from aromatic and cycloaliphatic groups are preferred for use in preparing the substituted succinic acylating agents. Particularly preferred are polyalkenes which are derived from homopolymers and interpolymers of terminal hydrocarbon olefins of 2 to about 8 carbon atoms, most especially from 2 to 4 carbon atoms. While interpolymers of terminal olefins are usually preferred, interpolymers optionally containing up to about 40% of polymer units derived from internal olefins of up to about 8 carbon atoms are also preferred. The most preferred polyalkenes are polypropylene and polyisobutenes.

Specific examples of terminal and internal olefin monomers which can be used to prepare the polyalkenes according to conventional, well-known polymerization techniques include ethylene; propylene; 1-butene; 2-butene; isobutene; 1-pentene; 1-hexene; 1-heptene, 2-butene; isobutene; 2-pentene, 1-hexene; 1-heptene; 1-octene; 1-nonene; 1-decene; 2-pentene; propylene-tetramer; diisobutylene; isobutylene trimer; 1,2-butadiene; 1,3-butadiene; 1,2-pentadiene; 1,3-pentadiene; 1,4-pentadiene; isoprene; 1,5-hexadiene; 2-chloro-1,3-butadiene; 2-methyl-1-heptene; 4-cyclohexyl-1-butene; 3-pentene; 4-octene; 3,3-di-methyl-1-pentene; styrene; 2,4-dichlorostyrene; divinylbenzene; vinyl acetate; allyl alcohol; 1-methyl-vinyl acetate; acrylonitrile; ethyl acrylate; methyl methacrylate; ethyl vinyl ether; and methyl vinyl ketone. Of these, the hydrocarbon polymerizable monomers are preferred and of these hydrocarbon monomers, the terminal olefin monomers are particularly preferred.

Specific examples of polyalkenes include polypropylenes, polybutenes, ethylene-propylene copolymers, styrene-isobutene copolymers, isobutene-1,3-butadiene copolymers, propene-isoprene copolymers, isobutene-chloroprene copolymers, isobutene-4-methylstyrene copolymers, copolymers of 1-hexene with 1,3-hexadiene, copolymers of 1-octene with 1-hexene, copolymers of 1-heptene with 1-pentene, copolymers of 3-methyl-1-butene with 1-octene, copolymers of 3,3-dimethyl-1-pentene with 1-hexene, and terpolymers of isobutene, styrene and piperylene. More specific examples of such interpolymers include copolymer of 95% (by weight) of isobutene with 5% (by weight) of styrene; terpolymer of 98% of isobutene with 1% of piperylene and 1% of chloroprene; terpolymer of 95% of isobutene with 2% of butene 1 and 3% of 1-hexene: terpolymer of 60% of isobutene with 20% of 1-pentene and 20% of octene-1; copolymer of 80% of 1-hexene and 20% of 1-heptene; terpolymer of 90% of isobutene with 2% of cyclohexene and 8% of propylene; and copolymer of 80% of ethylene and 20% of propylene. Preferred sources of polyalkenes are the polyisobutenes obtained by polymerization of $C_4$ refinery streams which contain both n-butene and isobutene in various proportions using a Lewis acid catalyst such as aluminum trichloride or boron trifluoride. These polybutenes usually contain predominantly (for example, greater than about 80% of the total repeating units) of repeating units of the configuration

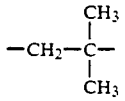

In preparing polyalkenes, conventional techniques known to those skilled in the art include suitably controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents, one or more of the above-described polyalkenes is reacted with one or more maleic or fumaric acidic reactants of the general formula

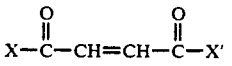

Formula IV wherein X and X' are as defined hereinbefore. Preferably the maleic and fumaric reactants will be one or more compounds corresponding to the formula

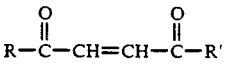

Formula V wherein R and R' are as previously defined herein. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents. The most preferred reactants are maleic acid, maleic anhydride, and mixtures of these.

Any of a variety of known procedures can be used to produce the substituted succinic acylating agents. For convenience and brevity, when the term "maleic reactant" is used hereafter, the term is generic to the reactants corresponding to Formulas IV and V above including mixtures of such reactants.

One procedure for preparing the substituted succinic acylating agents is illustrated, in part, by the two-step procedure described in U.S. Pat. No. 3,219,666. It involves first chlorinating the polyalkene until there is an average of at least about one chloro group for each molecule of polyalkene. Chlorination involves merely contacting the polyalkene with chlorine gas until the desired amount of chlorine is incorporated into the chlorinated polyalkene. Chlorination is generally carried out at a temperature of about 75° C. to about 125° C. If desired, a diluent can be used in the chlorination procedure. Suitable diluents for this purpose include poly- and perchlorinated and/or fluorinated alkanes and benzenes.

The second step in the two-step chlorination procedure is to react the chlorinated polyalkene with the maleic reactant at a temperature usually within the range of about 100° C. to about 200° C. The mole ratio of chlorinated polyalkene to maleic reactant is usually about 1:1. In this connection, a mole of chlorinated polyalkene may be regarded as the the weight of chlorinated polyalkene corresponding to the Mn value of the unchlorinated polyalkene. However, a stoichiometric excess of maleic reactant can be used, for example, a mole ratio of 1:2. If an average of more than about one chloro group per molecule of polyalkene is introduced during the chlorination step, then more than one mole of maleic reactant can react per molecule of chlorinated polyalkene. Accordingly, the ratio of chlorinated polyalkene to maleic reactant may be referred to in terms of equivalents, an equivalent weight of chlorinated polyalkene being the weight corresponding to the Mn value divided by the average number of chloro groups per molecule of chlorinated polyalkene. The equivalent weight of a maleic reactant is its molecular weight. Thus, the ratio of chlorinated polyalkene to maleic reactant will normally be such as to provided about one equivalent of maleic reactant for each mole of chlorinated polyalkene up to about one equivalent of maleic reactant for each equivalent of chlorinated polyalkene with the understanding that it is normally desirable to provide an excess of maleic reactant; for example, an excess of about 5% to about 25% by weight. Unreacted excess maleic reactant may be stripped from the reaction product, usually under vacuum, or reacted during a further stage of the process as explained below.

The resulting polyalkenyl-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing substituted succinic acid acylating agents utilizes a process described in U.S. Pat. No. 3,912,764 and U.K. Pat. No. 1,440,219. According to that process, the polyalkene and the maleic reactant are first reacted by heating them together in a direct alkylation procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkene. The direct alkylation step is conducted at temperatures of 180° C. to 250° C. During the chlorine-introducing stage, a temperature of 160° C. to 225° C. is employed.

Other known processes for preparing the substituted succinic acylating agents include the one-step process described in U.S. Pat. Nos. 3,215,707 and 3,231,587. Basically, this process involves preparing a mixture of the polyalkene and the maleic reactant in suitable proportions and introducing chlorine into the mixture, usually by passing chlorine gas through the mixture with agitation, while maintaining a temperature of at least about 140° C.

Usually, where the polyalkene is sufficiently fluid at 140° C. and above, there is no need to utilize an additional substantially inert, normally liquid solvent/diluent in the one-step process. However, if a solvent/diluent is employed, it is preferably one that resists chlorination such as the poly- and per-chlorinated and/or -fluorinated alkanes, cycloalkanes, and benzenes.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine so as to maximize chlorine utilization.

The minimum temperature at which the reaction in the one-step process takes place at a reasonable rate is about 140° C. Thus, the minimum temperature at which the process is normally carried out is in the neighborhood of 140° C. The preferred temperature range is usually between about 160° C. and about 220° C. Higher temperatures such as 250° C. or even higher may be used but usually with little advantage. In fact, excessively high temperatures may be disadvantageous because of the possibility that thermal degradation of either or both of the reactants may occur at excessively high temperatures.

In the one-step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used.

Further details concerning procedures for producing the substituted acylating agents have been extensively described in the patent literature, such as for example in U.S. Pat. No. 4,234,435. Thus, further amplification of such procedures herein is deemed unnecessary.

Component (ii). The other principal reactant utilized in forming the oil-soluble dispersants of this invention is a mixture consisting essentially of hydrocarbyl polyamines containing from 10 to 50 weight percent acyclic alkylene polyamines and 50 to 90 weight percent cyclic alkylene polyamines. Preferably such mixture is a mixture consisting essentially of polyethylene polyamines, especially a mixture having an overall average composition approximating that of polyethylene pentamine or a mixture having an overall average composition approximating that of polyethylene tetramine. Another useful mixture has an overall average composition approximating that of polyethylene hexamine. In this connection, the terms "polyalkylene" and "polyethylene", when utilized in conjunction with such terms as "polyamine", "tetramine", "pentamine", "hexamine", etc., denote that some of the adjacent nitrogen atoms in the product mixture are joined by a single alkylene group whereas other adjacent nitrogen atoms in the product mixture are joined by two alkylene groups thereby forming a cyclic configuration, i.e., a substituted piperazinyl structure. For example, the following mixture of compounds:

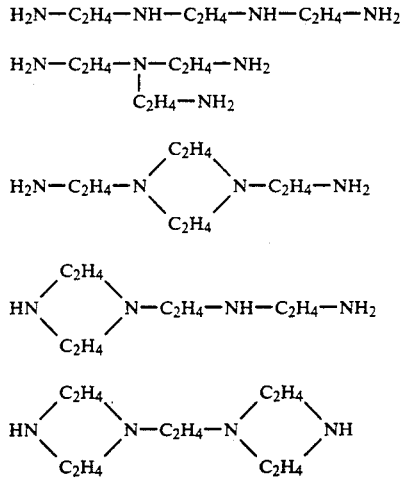

is termed herein a "polyethylene tetramine" inasmuch as its overall composition is that of a tetramine (four amino groups per molecule) in which acyclic components (a) and (b) have three ethylene groups per molecule, cyclic components (c) and (d) have four ethylene groups per molecule, and cyclic component (e) has five ethylene groups per molecule. Thus, if the above mixture contains from 10 to 50 weight percent of components (a) and (b)—or either of them—and from 90 to 50 weight percent of components (c), (d) or (e)—or any two or all three of them—it is a polyethylene tetramine suitable for use in the practice of this invention. Small amounts of lower and/or higher molecular weight species may of course be present in the mixture.

Among the especially preferred embodiments of this invention are formation of a succinimide product by:

1) use of a mixture of polyalkylene polyamines (10–50% acyclic; 90–50% cyclic) having an overall composition approximating that of polyalkylene pentamine and further characterized by containing on a weight basis:

a) from 2 to 10% of polyalkylene tetramines;

b) from 60 to 85% of polyalkylene pentamines;

c) from 10 to 20% of polyalkylene hexamines; and d) up to 10% lower and/or higher analogs of the foregoing.

2) use of a mixture of polyalkylene polyamines (10–50% acyclic; 90–50% cyclic) having an overall composition approximating that of polyalkylene pentamine and further characterized by containing on a weight basis:

a) at least 30% of the cyclic isomer depicted as

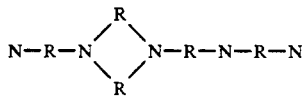

b) at least 10% of the cyclic isomer depicted as

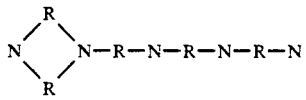

c) at least 2% of the acyclic branched isomer depicted as

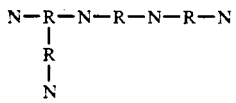

and d) at least 5% of the acyclic linear isomer depicted as

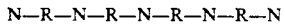

3) use of a mixture of polyalkylene polyamines (10–50% acyclic; 90–50% cyclic) having an overall composition approximating that of polyalkylene tetramine and further characterized by containing on a weight basis:

a) at least 5% linear acyclic alkylene polyamines;

b) at least 10% branched acyclic alkylene polyamines; and c) at least 60% cyclic alkylene polyamines.

4) use of a mixture of polyalkylene polyamines (10–50% acyclic; 90–50% cyclic) having an overall composition approximating that of polyalkylene tetramine and further characterized by containing on a weight basis:

a) at least 30% of the cyclic isomer depicted as

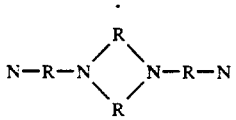

b) at least 20% of the cyclic isomer depicted as

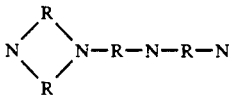

c) at least 10% of the acyclic branched isomer depicted as

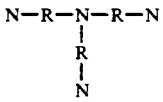

and d) at least 5% of the acyclic linear isomer depicted as

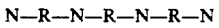

In the structural representations depicted in 2) and 4) above, R represents an alkylene group each of which contains up to 6 carbon atoms, preferably from 2 to 4 carbon atoms, and most preferably is the ethylene (dimethylene) group, i.e., the —$CH_2CH_2$— group.

In the above depictions, hydrogen atoms satisfying the trivalent character of the nitrogen atoms are not shown. Thus, when R is ethylene, the depiction

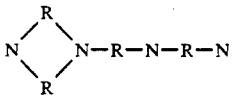

is a simplified version of the formula:

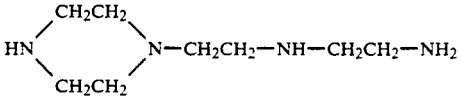

Using the above simplified method of depiction, the mixtures of alkylene polyamines used in the practice of this invention can include such acyclic species as:

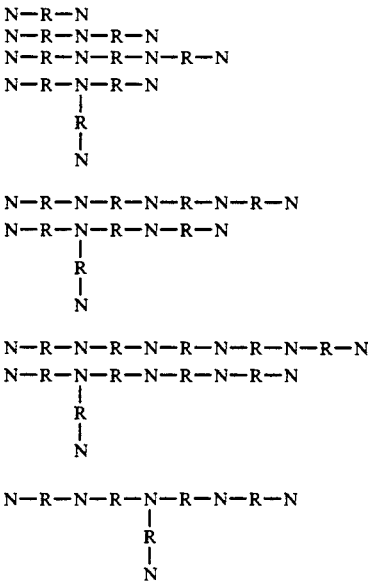

-continued
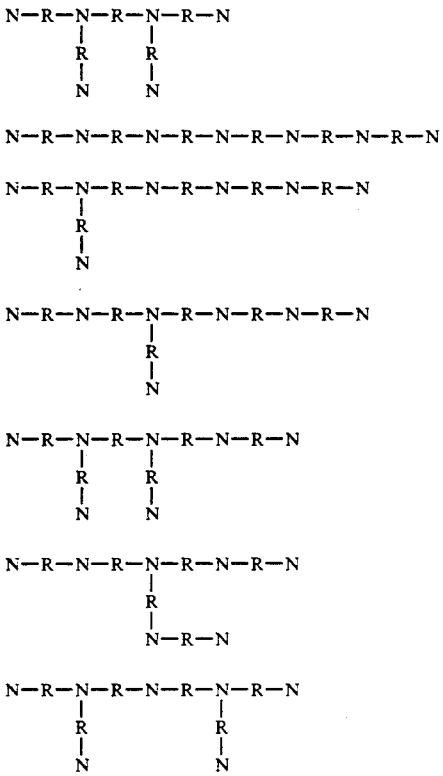
and similar higher molecular weight analogs up to those containing approximately 10 to 12 nitrogen atoms in the molecule.
Likewise, the mixtures of alkylene polyamines used in the practice of this invention can include such cyclic species as:
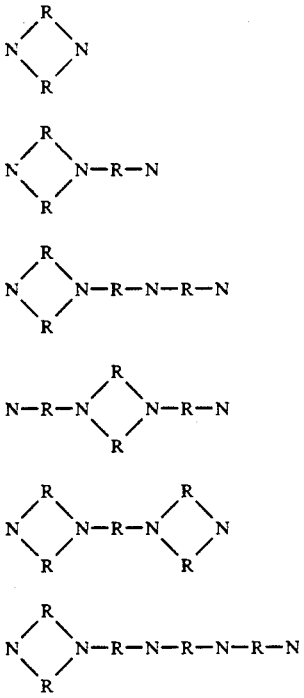
-continued
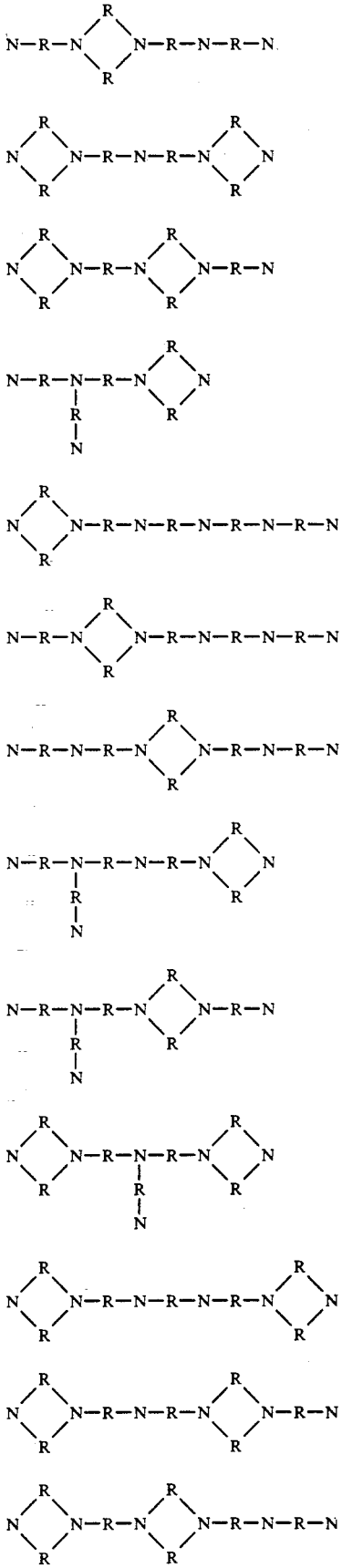

-continued

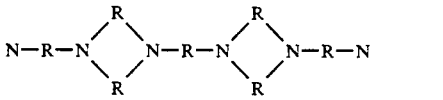

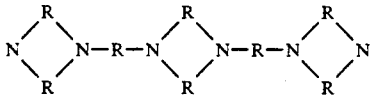

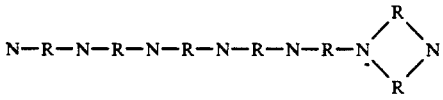

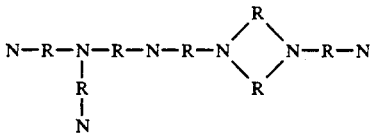

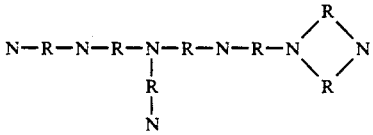

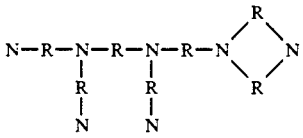

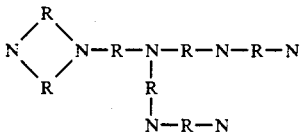

and similar isomeric polyalkylene heptamines and the higher molecular weight analogs up to those containing approximately 10 to 12 nitrogen atoms in the molecule.

Various procedures may be used for producing the mixtures of hydrocarbyl polyamines used in forming the dispersants of this invention. For example, one or more individual acyclic alkylene polyamines and one or more individual cyclic alkylene polyamines may be separately synthesized by known procedures and then combined in appropriate proportions. Alternatively and preferably, the mixtures utilized in forming the dispersants of this invention are concurrently synthesized in appropriate proportions. Thus, acyclic polyalkylene polyamines can be formed using procedures described in U.S. Pat. Nos. 4,036,881; 4,314,083; or 4,399,308. These can be blended with cyclic polyalkylene polyamines formed as in USSR 1,182,040 (Sep. 30, 1985). Concurrent production of acyclic and cyclic polyalkylene polyamines can be effected, for example, by a process such as described in Romanian Patent 90714 (Nov. 29, 1986). See also U.S. Pat. No. 3,462,493.

A feature of this invention is that when utilizing suitable mixtures of cyclic and acyclic polyalkylene polyamines that are produced concurrently under suitable reaction conditions, no special separation procedures are required. Thus such mixtures can be produced and utilized in the practice of this invention on an economical basis.

Reaction Conditions. As noted above, the succinimide dispersants of this invention are prepared by a process which comprises reacting (i) at least one aliphatic hydrocarbyl substituted succinic acylating agent in which the hydrocarbyl substituent contains an average of at least 40 carbon atoms with (ii) a mixture consisting essentially of hydrocarbyl polyamines containing from 10 to 50 weight percent acyclic alkylene polyamines and 50 to 90 weight percent cyclic alkylene polyamines. The proportions of components (i) and (ii) utilized in the reaction can be varied to suit the needs of the occasion. Generally speaking, however, the reaction mixture will contain the reactants in mole ratios of from 1 to 5 moles of acylating agent per mole of polyalkylene polyamines. The preferred ratios fall in the range of 1.1 to 2.5 moles of acylating agent per mole of polyalkylene polyamine. The reaction is conducted at conventional temperatures in the range of about 80° C. to about 200° C., more preferably about 140° C. to about 180° C. These reactions may be conducted in the presence or absence of an ancillary diluent or liquid reaction medium, such as a mineral lubricating oil solvent. If the reaction is conducted in the absence of an ancillary solvent of this type, such is usually added to the reaction product on completion of the reaction. In this way the final product is in the form of a convenient solution in lubricating oil and thus is compatible with a lubricating oil base stock. Suitable solvent oils are the same as the oils used as a lubricating oil base stock and these generally include lubricating oils having a viscosity (ASTM D 445) of 2 to 40, preferably 3 to 12 $mm^2$/sec at 100° C., with the primarily paraffinic mineral oils such as Solvent 100 Neutral being particularly preferred. Other types of lubricating oil base stocks can be used, such as synthetic lubricants including polyesters, poly-α-olefins (e.g., hydrogenated or unhydrogenated α-olefin oligomers such as hydrogenated poly-1-decene), and the like. Blends of mineral oil and synthetic lubricating oils are also suitable for various applications in accordance with this invention.

Post-treatment Procedures. The succinimide dispersants of this invention can be utilized with or without post-treatment with other reagents. When utilizing a post-treatment procedure, any of a wide variety of post-treating agents can be used. Such post-treating agents include, for example, boron oxide, boron oxide hydrate, boron halides, boron acids, esters of boron acids, carbon disulphide, hydrogen sulphide, sulphur, sulphur chloride, alkenyl cyanides, carboxylic acid acylating agents, aldehyde, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulphides, phosphorus oxides, phosphoric acid, phosphorous acid, hydrocarbyl thiocyanates, hydrocarbyl isocyanates, hydrocarbyl isothiocyanates, epoxides, episulphides, formaldehyde or formaldehyde producing compounds plus phenols, and sulphur plus phenols.

Preferred post-treating agents and procedures involve use of phosphorus-containing post-treating agents or boron-containing post-treating agents.

The phosphorus-containing post-treating agents comprise both inorganic and organic compounds capable of reacting with the dispersant in order to introduce phosphorus or phosphorus-containing moieties into the dispersant. Thus use can be made of phosphorus acids, phosphorus oxides, phosphorus sulphides, phosphorus esters, and like compounds. A few examples of such compounds include such inorganic phosphorus compounds as phosphoric acid, phosphorous acid, phosphorus pentoxide, phosphorus pentasulphide, tetraphosphorus heptasulphide, etc., and such organic phosphorus compounds as monohydrocarbyl phosphites, dihydrocarbyl phosphites, trihydrocarbyl phosphites, monohydrocarbyl phosphates, dihydrocarbyl phosphates, trihydrocarbyl phosphates, the hydrocarbyl pyrophosphates, and their partial or total sulphur analogs wherein the hydrocarbyl group(s) contain up to about 30 carbon atoms each.

The boron-containing post-treating agents likewise comprise both inorganic and organic compounds capable of reacting with the dispersant in order to introduce boron or boron-containing moieties into the dispersant. Accordingly, use can be made of such inorganic boron compounds as the boron acids, and the boron oxides, including their hydrates. Typical organic boron compounds include esters of boron acids, such as the orthoborate esters, metaborate esters, biborate esters, pyroboric acid esters, and the like.

It is particularly preferred to utilize a combination of a phosphorus compound and a boron compound in the post-treatment procedures conducted pursuant to this invention so that the product of this invention is both phosphorylated and boronated. Examples of inorganic phosphorus acids and anhydrides which are useful in forming the preferred post-treated products of this invention include phosphorous acid, phosphoric acid, hypophosphoric acid, phosphorus trioxide ($P_2O_3$), phosphorus tetraoxide ($P_2O_4$), and phosphoric anhydride ($P_2O_5$). Mixtures of two or more such compounds can be used. Most preferred is phosphorous acid ($H_3PO_3$). Illustrative examples of dihydrocarbyl hydrogen phosphites which may be reacted with the basic nitrogen-containing dispersants for the purposes of this invention, include diethyl hydrogen phosphite, dibutyl hydrogen phosphite, di-2-ethylhexyl hydrogen phosphite, didecyl hydrogen phosphite, dicyclohexyl hydrogen phosphite, diphenyl hydrogen phosphite, isopropyl octyl hydrogen phosphite, ditetradecyl hydrogen phosphite, dibenzyl hydrogen phosphite, and the like. Normally the hydrocarbyl groups will each contain up to about 30 carbon atoms. Mixtures of two or more such phosphites can be employed. Dibutyl hydrogen phosphite is a preferred dihydrocarbyl phosphite. Among the monohydrocarbyl-phosphites which can be utilized in the practice of this invention are included such compounds as monomethyl phosphite, monoethyl phosphite, monobutyl phosphite, monohexyl phosphite, monocresyl phosphite, monobenzyl phosphite, monoallyl phosphite, and the like, and mixtures of two or more such compounds. The hydrocarbyl group will normally contain up to about 30 carbon atoms. Mixtures of monohydrocarbyl and dihydrocarbyl phosphites are also suitable, as are the trihydrocarbyl phosphites and the sulphur analogs of the foregoing phosphites. Thus the phosphites may be represented by the formula:

$$(R^1X^2)(R^2X^2)(R^3X^3)P$$

where each of $R^1$, $R^2$, and $R^3$ is, independently, a hydrocarbyl group or a hydrogen atom, where each of $X^1$, $X^2$, and $X^3$ is, independently, an oxygen atom or a sulphur atom, and where at least one of $R^1$, $R^2$, and $R^3$ is a hydrocarbyl group.

The corresponding phosphates and phosphorothioates are also suitable post-treating agents for use in the practice of this invention. Such compounds may be represented by the formula $$(R^1X^1)(R^2X^2)(R^3X^3)P{=}X^4$$

where each of $R^1$, $R^2$, and $R^3$ is, independently, a hydrocarbyl group or a hydrogen atom, where each of $X^1$, $X^2$, $X^3$ and $X^4$ is, independently, an oxygen atom or a sulphur atom, and where at least one of $R^1$, $R^2$, and $R^3$ is a hydrocarbyl group.

A particularly preferred post-treating procedure involves reacting a succinimide of this invention with (a) at least one oxyacid of phosphorus and/or at least one anhydride thereof; or (b) at least one monohydrocarbyl phosphite and/or at least one dihydrocarbyl hydrogen phosphite; or (c) any combination of at least one from (a) and at least one from (b); and sequentially, and most preferably concurrently, with (d) at least one boron compound. In either case—i.e., where the succinimide is reacted sequentially or concurrently in either order with (a) and (d), (b) and (d), or (c) and (d)—the reaction is conducted by heating the reactants at a reaction temperature within the range of 50° to 150° C., preferably about 90° to 110° C., most preferably at about 100° C. The over-all reaction time may vary from about 1 hour or less to about 6 hours or more depending on the temperature and the particular reactants employed. In any event, the reactants are heated, preferably with agitation, to produce a clear, oil-soluble product. Such reaction can be carried out in the absence of solvent by mixing and heating the reactants. Preferably, however, water is added to facilitate the initial dissolution of the boron compound. Water formed in the reaction and any added water is then removed by vacuum distillation at temperatures of from 100°-140° C. Preferably, the reaction is carried out in a diluent oil or a solvent such as a mixture of aromatic hydrocarbons. One advantage of utilizing the combination of a phosphorus-containing post-treating agent and a boron-containing post-treating agent is that in many cases the treatment can be conducted in the presence of other components normally present in lubricating oil formulations.

In the preferred embodiments of this invention wherein a boron compound is reacted sequentially in either order or preferably concurrently with the basic nitrogen-containing dispersant(s) and the phosphorus reactant(s), use can be made of such compounds as, for example, boron acids such as boric acid, boronic acid, tetraboric acid, metaboric acid, pyroboric acid, esters of such acids, such as mono-, di- and tri-organic esters with alcohols having 1 to 20 carbon atoms, e.g., methanol, ethanol, propanol, isopropanol, the butanols, the pentanols, the hexanols, the octanols, the decanols, ethylene glycol, propylene glycol and the like, and boron oxides such as boron oxide and boron oxide hydrate.

Another particularly preferred embodiment of this invention involves the post-treatment of the succinimides of this invention with a low molecular weight dicarboxylic acid acylating agent such as maleic anhydride, maleic acid, malic acid, fumaric acid, azelaic acid, adipic acid, succinic acid, alkenyl succinic acids and/or anhydrides (in which the alkenyl group contains up to about 24 carbon atoms), and the like. Such acylating agents are reacted with the succinimide dispersants of this invention at temperatures in the range of 80° to 200° C., more preferably 140° to 180° C. These reactions may be conducted in the presence or absence of an ancillary diluent or liquid reaction medium, such as a mineral oil solvent. If the reaction is conducted in the absence of an ancillary solvent of this type, such is usually added to the reaction product on completion of the reaction. In this way the final product is in the form of a convenient solution in lubricating oil and thus is compatible with a lubricating oil base stock. Suitable solvent oils are the same as the oils used as a lubricating oil base stock and these generally include lubricating oils having a viscosity (ASTM D 445) of 2 to 40, preferably 3 to 12 $mm^2/sec$ at 100° C., with the primarily paraffinic mineral oils such as Solvent 100 Neutral being particularly preferred. Other types of lubricating oil base stocks can be used, such as synthetic lubricants including polyesters, poly-o-olefins (e.g., hydrogenated or unhydrogenated α-olefin oligomers such as hydrogenated poly-1-decene), and the like. Blends of mineral oil and synthetic lubricating oils are also suitable for various applications in accordance with this invention.

It will be appreciated that other types of post-treating agents can be used in the practice of this invention, such as those referred to hereinabove. Since post-treating processes involving those post-treating reagents are known as regards post-treatment of reaction products of amines and high molecular weight acylating agents of the prior art, detailed descriptions of these processes is deemed unnecessary. In order to apply the prior art processes to the succinimides of this invention, all that is required is that the reaction conditions, ratio of reactants, and like processing details as described in the prior art be applied to the novel succinimides of this invention. Reference may be had to the following patents for details concerning such prior art post-treating procedures: U.S. Pat. Nos. 3,087,936; 3,184,411; 3,185,645; 3,185,704; 3,200,107; 3,254,025; 3,256,185; 3,278,550; 3,280,034; 3,281,428; 3,282,955; 3,284,410; 3,312,619; 3,338,832; 3,344,069; 3,366,569; 3,367,943; 3,369,021; 3,373,111; 3,390,086; 3,458,530; 3,470,098; 3,502,677; 3,511,780; 3,513,093; 3,541,012; 3,551,466; 3,558,743, 3,573,205; 3,652,616; 3,718,663; 3,749,695; 3,865,740; 3,865,813; 3,954,639; 4,338,205; 4,401,581; 4,410,437; 4,428,849; 4,548,724; 4,554,086; 4,608,185; 4,612,132; 4,614,603, 4,615,826; 4,645,515; 4,710,201; 4,713,191; 4,746,446; 4,747,850; 4,747,963; 4,747,964; 4,747,965; and 4,857,214. See also British Patents 1,085,903 and 1,162,436. Alternatively, pre-treatment procedures such as described in U.S. Pat. Nos. 3,415,750 and 4,713,189 can be used.

Finished lubricating oil compositions of this invention are prepared containing the dispersant of this invention together with conventional amounts of other additives to provide their normal attendant functions.

The benefits achievable by the practice of this invention are illustrated in the following specific examples which are not to be construed as limitations on this invention. In Examples 1–4, use is made of the standard Volkswagen P. VW 3334 Seal Test in order to demonstrate the enhancement in fluoroelastomer compatibility achievable by the practice of this invention. In the examples, all parts and percentages are by weight unless otherwise clearly specified.

The Volkswagen P.VW 3334 Seal Test involves keeping a test specimen of fluoroelastomer (VITON AK6) in an oil blend at 150° C. for 96 hours and then comparing both the change in elongation to break and the tensile strength of the test specimen to the corresponding properties of a fresh specimen of the same fluoroelastomer. The exposed test specimen is also examined for the presence of cracks. In these tests, a lubricant passes the test if the exposed test specimen exhibits a change in elongation to break (as compared to an untested specimen) of no more than −25% and a tensile strength (as compared to an untested specimen) of no more than −20%, and possesses no cracks. Another test which can be used to measure the effect of lubricant additives on fluoroelastomers is the CCMC Viton Seal Test, CEC L-39-T-87 Oil/Elastomer Compatibility Test. This test is similar to the VW Test except that it is a 7-day test rather than a 4-day test, the elastomer is VITON RE I, and the pass/fail points are −50% tensile strength and −60% elongation. Experiments conducted to date indicate that the CCMC Seal Test is less stringent than the VW Seal Test.

EXAMPLE 1

A succinimide dispersant of this invention is prepared by reacting 450 parts of polyisobutenyl succinic anhydride formed from polyisobutene having a number average molecular weight of 1300 with 25.2 parts of a mixture of polyethylene polyamines having an overall composition approximating that of polyethylene tetramine. Such mixture contains the following percentages of the specified components as measured by integration of the peaks in a gas-liquid chromatogram:

| | Percentage |
|---|---|
| Cyclic Polyethylene Polyamines | |
| N-(2-aminoethyl)piperazine | 1.6 |
| N,N'-bis(2-aminoethyl)piperazine | 45.8 |
| N-[2-(1-piperazinyl)ethyl]-1,2-ethanediamine | 28.8 |
| | 76.2 |
| Acyclic Polyethylene Polyamines | |
| Diethylene triamine | 0.4 |
| Linear triethylene tetramine | 8.2 |
| Tris(2-aminoethyl)amine | 14.2 |
| | 22.8 |
| Other Components | 1.0 |

The reaction between the foregoing polyisobutenyl succinic anhydride and the foregoing mixture of ethylene polyamines is conducted at 165° C. until evolution of water ceases (between approximately 4 to 7 hours). Upon completion of the reaction, the product is diluted with 100 solvent neutral mineral oil to a nitrogen content in the solution of 1.20 percent.

EXAMPLE 2 (COMPARATIVE)

A succinimide dispersant not of this invention is prepared as in Example 1 except that the mixture of polyethylene polyamines having an overall composition approximating that of triethylene tetramine used contains the following percentages of the specified components as measured by integration of the peaks in a gas-liquid chromatogram:

| | Percentage |
|---|---|
| Cyclic Polyethylene Polyamines | |
| N-(2-aminoethyl)piperazine | 0.1 |
| N,N'-bis(2-aminoethyl)piperazine | 2.9 |
| N-[2-(1-piperazinyl)ethyl]-1,2-ethanediamine | 3.9 |
| | 6.9 |
| Acyclic Polyethylene Polyamines | |
| Diethylene triamine | 1.6 |
| Linear triethylene tetramine | 87.3 |
| Tris(2-aminoethyl)amine | 3.7 |
| | 92.6 |

-continued

| | Percentage |
|---|---|
| Other Components | 0.5 |

Upon completion of the reaction, the product is diluted with 100 solvent neutral mineral oil to a nitrogen content in the solution of 1.31 percent.

EXAMPLE 3

A succinimide dispersant of this invention is prepared by reacting 450 parts of polyisobutenyl succinic anhydride formed from polyisobutene having a number average molecular weight of 1300 with 32.6 parts of a mixture of polyethylene polyamines having an overall composition approximating that of polyethylene pentamine. Such mixture contains the following percentages of the specified components as measured by integration of the peaks in a gas-liquid chromatogram:

| | Percentage |
|---|---|
| Cyclic Pentaethylene Pentamines | |
| N-[(4-aminoethyl-1-piperazinyl)ethyl-1,2-ethanediamine | 49.2 |
| N-(2-aminoethyl)-N'-[2-(1-piperazinyl)ethyl]-1,2-ethanediamine | 14.7 |
| | 63.9 |
| Acyclic Tetraethylene Pentamines | |
| Linear tetraethylene pentamine | 7.2 |
| N,N-bis(2-aminoethyl)-N'-2-aminoethyl-1,2-ethanediamine | 4.2 |
| | 11.4 |
| Polyethylene Tetramines | 5.7 |
| Polyethylene Hexamines | 15.7 |
| Other Components | 3.3 |

The reaction between the foregoing polyisobutenyl succinic anhydride and the foregoing mixture of ethylene polyamines is conducted at 165° C. until evolution of water ceases (between approximately 4 to 7 hours). Upon completion of the reaction, the product is diluted with 100 solvent neutral mineral oil to a nitrogen content in the solution of 1.62 percent.

EXAMPLE 4 (COMPARATIVE)

A succinimide dispersant not of this invention is prepared as in Example 3 except that the mixture of polyethylene polyamines having an overall composition approximating that of polyethylene pentamine used contains the following percentages of the specified components as measured by integration of the peaks in a gas-liquid chromatogram;

| | Percentage |
|---|---|
| Cyclic Pentaethylene Pentamines | |
| N-[(4-aminoethyl-1-piperazinyl)ethyl-1,2-ethanediamine | 13.1 |
| N-(2-aminoethyl)-N'-[2-(1-piperazinyl)ethyl]-1,2-ethanediamine | 2.9 |
| | 16.0 |
| Acyclic Tetraethylene Pentamines | |
| Linear tetraethylene pentamine | 52.3 |
| N,N-bis(2-aminoethyl)-N'-2-aminoethyl-1,2-ethanediamine | 24.4 |
| | 76.7 |
| Polyethylene Tetramines | 2.3 |
| Polyethylene Hexamines | 4.8 |
| Other Components | 0.2 |

Upon completion of the reaction, the product is diluted with 100 solvent neutral mineral oil to a nitrogen content in the solution of 1.81 percent.

Finished gasoline engine crankcase lubricating oils containing the substituted succinimide dispersants of Examples 1–4 were formulated. Each such oil contained 5.8% of the additive concentrate comprising the succinimide dispersant and the diluent oil. In addition, each finished lubricating oil contained 3.4% of an additive formulation comprising conventional amounts of overbased sulfonates, zinc dialkyl dithiophosphate, antioxidant, rust inhibitor, and antifoam agent. Additionally, each such oil contained an alkyl polymethacrylate pour point depressant and an olefin copolymer viscosity index improver such that the lubricant was formulated as an SAE 15W/40 crankcase lubricating oil.

The resultant finished lubricating oils were subjected to the Volkswagen P.VW 3334 Seal Test. The results of this series of tests are summarised in Table 1.

TABLE 1

| | Results of Volkswagen Seal Tests | | |
|---|---|---|---|
| Succinimide Used | Change in Elongation to Break Compared to Fresh Seal, % | Tensile Strength Compared to Fresh Seal, % | Cracking |
| Example 1 | −22.6 | −25.6 | Pass |
| Example 2 | −42.4 | −52.2 | Fail |
| Example 3 | −23.6 | −28.4 | Pass |
| Example 4 | −39.4 | −51.6 | Fail |

The following examples still further illustrate the practice of this invention.

EXAMPLE 5

A polyethylene tetramine mixture consisting essentially of approximately 37% linear triethylene tetramine $$(H_2N—C_2H_4—NH—C_2H_4—NH—C_2H_4—NH_2)$$

and approximately 63% of piperazinoethylethylene diamine

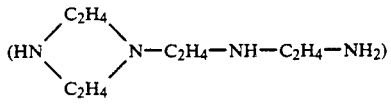

is formed as in Example 8 of U.S. Pat. No. 3,462,493 by reacting ethylene diamine and ethylene dichloride in a mole ratio of 5:1 at 30° C. for 390 minutes, treating the reaction mixture with a substantial excess of aqueous sodium hydroxide solution, and recovering the linear triethylene tetramine and piperazinoethylethylene diamine by subjecting the resultant reaction mixture to distillation at subatmospheric pressure. The foregoing mixture of linear triethylene tetramine and piperazinoethylethylene diamine is reacted at 165° C. with polyisobutenyl succinic anhydride in a mole ratio of 1.5 moles of polyisobutenyl succinic anhydride per mole of polyethylene tetramines. The polyisobutenyl succinic anhydride used in this reaction is formed from polyisobutene having a number average molecular weight of 980. The succinimide product formed in the reaction is diluted with 100 solvent neutral mineral oil.

EXAMPLES 6–10

Five succinimide products of this invention are prepared by reacting polyisobutenyl succinic anhydride (formed from polyisobutene having a number average molecular weight of 1250) with the following respective mixtures of polyethylene polyamines formed by blending together the individual components in the proportions specified:

| Ex. No. | Proportions, Weight Percent | | | |
|---|---|---|---|---|
| | AEP | TETA | BAEP | TEPA |
| 6 | 30 | 10 | 40 | 20 |
| 7 | 20 | 20 | 40 | 20 |
| 8 | 20 | 25 | 30 | 25 |
| 9 | 40 | 10 | 40 | 10 |
| 10 | 45 | 15 | 25 | 15 |

AEP N-(2-aminoethyl) piperazine
TETA Acyclic triethylene tetramines
BAEP N,N'-bis(2-aminoethyl)piperazine
TEPA Acyclic tetraethylene pentamines The reactants are employed in mole ratios of 1.8 moles of the polyisobutenyl succinic anhydride per mole of the polyethylene polyamines. The reactions are conducted at 165° C. until evolution of water ceases. The resultant products are each dissolved in 100 solvent neutral mineral oil thereby forming five pre-blend concentrates of this invention.

EXAMPLES 11-15

To portions of the respective pre-blend concentrates of Examples 6-10 are added phosphorous acid, boric acid and water in proportions of 250 parts of the respective succinimides, 100 parts of mineral oil diluent, 8 parts of phosphorous acid, 8 parts of boric acid, and 3 parts of water. The mixtures are heated at 100° C. for 2 hours until all of the solid materials are dissolved. A vacuum of 40 mm is gradually drawn on the product to remove the water formed while the temperature is slowly raised to 110° C. The resultant succinimides are both phosphorylated and boronated.

EXAMPLES 16-20

To portions of the respective pre-blend concentrates of Examples 6-10 are added, respectively, maleic anhydride, maleic acid, fumaric acid, malic acid, and adipic acid in amounts corresponding to 1.3 moles thereof per mole of polyethylene polyamines used in the syntheses of Examples 6-10. The resultant mixtures are heated at 165°-170° C. for 1.5 hours to produce post-treated acylated succinimide products of this invention.

The dispersants of this invention can be incorporated in a wide variety of lubricants in effective amounts to provide active ingredient concentrations in finished formulations generally within the range of 0.1 to 10 weight percent, for example, 1 to 9 weight percent, preferably 2 to 8 weight percent, of the total composition. Conventionally, the dispersants are admixed with the lubricating oils as dispersant solution concentrates which usually contain 50 weight percent or more of the active ingredient additive compound dissolved in mineral oil, preferably a mineral oil having an ASTM D-445 viscosity of 2 to 40, preferably 3 to 12 centistokes at 100° C. The lubricating oil not only can be hydrocarbon oils of lubricating viscosity derived from petroleum but also can be natural oils of suitable viscosities such as rapeseed oil, etc., and synthetic lubricating oils such as hydrogenated polyolefin oils; poly-α-olefins (e.g., hydrogenated or unhydrogenated α-olefin oligomers such as hydrogenated poly-1-decene); alkyl esters of dicarboxylic acids; complex esters of dicarboxylic acid, polyglycol and alcohol; alkyl esters of carbonic or phosphoric acids; polysilicones; fluorohydrocarbon oils; and mixtures or lubricating oils and synthetic oils in any proportion, etc. The term "lubricating oil" for this disclosure includes all the foregoing. The dispersant may be conveniently dispensed as a concentrate of 10 to 80 weight percent of mineral oil, e.g., Solvent 100 Neutral oil with or without other additives being present and such concentrates are a further embodiment of this invention.

The dispersants of this invention can thus be used in lubricating oil and functional fluid compositions, such as automotive crankcase lubricating oils, automatic transmission fluids, gear oils, hydraulic oils, cutting oils, etc., in which the base oil of lubricating viscosity is a mineral oil, a synthetic oil, a natural oil such as a vegetable oil, or a mixture thereof, e.g. a mixture of a mineral oil and a synthetic oil.

Suitable mineral oils include those of appropriate viscosity refined from crude oil of any source including Gulf Coast, Midcontinent, Pennsylvania, California, Alaska, Middle East, North Sea and the like. Standard refinery operations may be used in processing the mineral oil.

Synthetic oils include both hydrocarbon synthetic oils and synthetic esters. Useful synthetic hydrocarbon oils include liquid alpha-olefin polymers of appropriate viscosity. Especially useful are hydrogenated or unhydrogenated liquid oligomers of $C_6$-$C_{16}$ alpha-olefins, such as hydrogenated or unhydrogenated alpha-decene trimer. Alkyl benzenes of appropriate viscosity, e.g. didodecylbenzene, can also be used.

Useful synthetic esters include the esters of monocarboxylic and polycarboxylic acids with monohydroxy alcohols and polyols. Typical examples are didodecyl adipate, trimethylolpropane tripelargonate, pentaerythritol tetracaproate, di(2-ethylhexyl) adipate, and dilauryl sebacate. Complex esters made from mixtures of mono- and dicarboxylic acids and mono- and/or polyhydric alkanols can also be used.

Typical natural oils that may be used include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and the like. Such oils may be partially or fully hydrogenated, if desired.

Viscosity index improvers may be included in the mineral, synthetic and natural oils (or any blends thereof) in order to achieve the viscosity properties deemed necessary or desirable.

The finished lubricating oil and functional fluid compositions of the present invention will usually also contain other well-known additives such as the zinc di-alkyl ($C_3$-$C_{10}$) and/or diaryl ($C_6$-$C_{20}$) dithiophosphate wear inhibitors, generally present in amounts of about 0.5 to 5 weight percent. Useful detergents for use in such compositions include the oil-soluble normal basic or overbased metal, e.g., calcium, magnesium, brium, etc., salts of petroleum naphthenic acids, petroleum sulfonic acids, alkyl benzene sulphonic acids, oil-soluble fatty acids, alkyl salicylic acids, sulphurised or unsulphurised alkyl phenates, and hydrolyzed or unhydrolyzed phosphosulphurised polyolefins. Gasoline engine crankcase lubricants typically contain, for example, from 0.5 to 5 weight percent of one or more detergent additives. Diesel engine crankcase oils may contain substantially higher levels of detergent additives. Preferred detergents are the calcium and magnesium normal or overbased phenates, sulphurised phenates or sulphonates.

Pour point depressants which may be present in amounts of from 0.01 to 1 weight percent include wax alkylated aromatic hydrocarbons, olefin polymers and copolymers, and acrylate and methacrylate polymers and copolymers.

Viscosity index improvers, the concentrations of which may vary in the lubricants from 0.2 to 15 weight percent, (preferably from about 0.5 to about 5 weight percent) depending on the viscosity grade required, include hydrocarbon polymers grafted with, for example, nitrogen-containing monomers, olefin polymers such as polybutene, ethylene-propylene copolymers, hydrogenated polymers and copolymers and terpolymers of styrene with isoprene and/or butadiene, polymers of alkyl acrylates or alkyl methacrylates, copolymers of alkyl methacrylates with N-vinyl pyrrolidone or dimethylaminoalkyl methacrylate, post-grafted polymers of ethylene-propylene with an active monomer such as maleic anhydride which may be further reacted with an alcohol or an alkylene polyamine, styrene/-maleic anhydride polymers post-treated with alcohols and amines, etc.

Antiwear activity can be provided by about 0.01 to 2 weight percent in the oil of the aforementioned metal dihydrocarbyl dithiophosphates and the corresponding precursor esters, phosphosulphurised pinenes, sulphurised olefins and hydrocarbons, sulphurised fatty esters and alkyl polysulphides. Preferred are the zinc dihydrocarbyl dithiophosphates which are salts of dihydrocarbyl esters of dithiophosphoric acids.

Other ashless dispersants may be included in the compositions of this invention, if desired. For this purpose, use may be made of long chain hydrocarbyl amines, Mannich type reaction products formed from suitable amines, phenols, and aldehydes such as formaldehyde, conventional types of succinimide dispersants, succinic acid esters, succinic acid ester amides, or combinations of two or more of the foregoing.

Other additives include effective amounts of friction modifiers or fuel economy additives such as the alkyl phosphonates as disclosed in U.S. Pat. No. 4,356,097, aliphatic hydrocarbyl substituted succinimides as disclosed in EPO 0020037, dimer acid esters, as disclosed in U.S. Pat. No. 4,105,571, oleamide, etc., which are present in the oil in amounts of 0.1 to 5 weight percent. Glycerol oleates are another example of fuel economy additives and these are usually present in very small amounts, such as 0.05 to 0.2 weight percent based on the weight of the formulated oil.

Antioxidants or thermal stabilisers which may be included in the lubricant and functional fluid compositions of this invention include hindered phenols (e.g., 2,6-di-tert-butyl-paracresol, 2,6-di-tert-butylphenol, 4,4'-methylenebis(2,6-di-tert-butylphenol), and mixed methylene bridged polyalkyl phenols), amines, sulphurised phenols, alkyl phenothiazines, phosphite esters, substituted triazines and ureas, and copper compounds such as copper naphthenate and copper oleate, among others. Preferred antioxidants are sterically hindered phenols, methylene-bridged sterically hindered polyphenols, and secondary aromatic amines, and mixtures thereof. Antioxidants are usually present in the lubricant in amounts of from 0.001 to 2 weight percent.

Other well known components such as rust inhibitors, wax modifiers, foam inhibitors, copper passivators, sulphur scavengers, seal swell agents, color stabilisers, and like materials can be included in the compositions of this invention, provided of course that they are compatible with the antioxidant system of this invention and the other component or components being employed.

The dispersants of this invention can also be employed in various fuel compositions, such as diesel fuels, burner fuels, gas oils, bunker fuels, and similar products.

As noted above, this invention also includes among its embodiments improved methods of lubricating mechanical parts in the presence of at least one fluoroelastomer surface. In the practice of such methods, the lubrication is effected by means of a lubricating oil or functional fluid containing a dispersant of this invention. The practice of such methods results in a lower—oftentimes a substantially lower—amount of degradation of the fluoroelastomer contacted by the lubricating oil or functional fluid containing such dispersants as compared to the amount of degradation that would occur under the same conditions using the same oil or fluid composition containing the same quantity of succinimide dispersant made in the same way except for the use in the synthesis of the dispersant of a conventional mixture of alkylene polyamines predominating in acyclic isomers.

In another of its forms this invention provides in combination, (a) a mechanical mechanism containing moving parts to be lubricated, (b) a lubricating oil or functional fluid composition for lubricating such parts, and (c) a fluoroelastomer in contact with at least a portion of such lubricating oil or functional fluid during operation of such mechanism, characterized in that the lubricating oil or functional fluid composition for effecting such lubrication contains as a dispersant therefor, a dispersant prepared by the process of this invention described hereinabove. Among the mechanical mechanisms and systems lubricated in this manner are the crankcases of internal combustion engines; vehicular transmissions; hydraulic systems; hypoid axles; mechanical steering drives in passenger cars, in trucks, and in cross-country vehicles; planetary hub reduction axles and transfer gear boxes in utility vehicles such as trucks; pinion hub reduction gear boxes; synchromesh and synchroniser type gear boxes; power take-off gears; and limited slip rear axles. The dispersants can also be utilized in metal working, machining, and cutting oils such as are applied to work pieces during cutting and shaping operations.

I claim:

1. An oil-soluble dispersant composition formed by reacting (i) at least one aliphatic hydrocarbyl substituted succinic acylating agent in which the substituent is principally alkyl, alkenyl, or polyethylenically unsaturated alkenyl, or any combination thereof and wherein such substituent has an average of from 50 to 5000 carbon atoms with (ii) a mixture consisting essentially of hydrocarbyl polyamines containing from 10 to 50 weight percent acyclic polyalkylene polyamines and 50 to 90 weight percent cyclic polyalkylene polyamines.

2. A composition as claimed in claim 1 wherein component (ii) used in forming said composition consists essentially of a mixture of polyethylene polyamines.

3. A composition as claimed in claim 1 wherein component (ii) used in forming said composition consists essentially of a mixture of polyethylene polyamines having an overall average composition approximating that of polyethylene pentamine.

4. A composition as claimed in claim 3 wherein said mixture of polyethylene polyamines is further characterized by containing on a weight basis:

a) from 2 to 10% of polyethylene tetramines;

b) from 60 to 85% of polyethylene pentamines;
c) from 10 to 20% of polyethylene hexamines; and
d) up to 10% lower and/or higher analogs of the foregoing.

5. A composition as claimed in claim 3 wherein said mixture of polyethylene polyamines is further characterized by containing on a weight basis:

a) at least 30% of the isomer depicted as

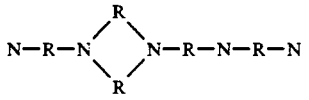

b) at least 10% of the isomer depicted as

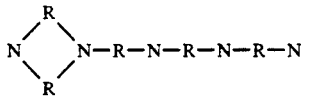

c) at least 2% of the isomer depicted as

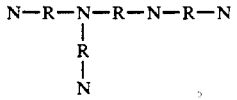

and d) at least 5% of the isomer depicted as wherein in each depiction hereof R is an ethylene group.

6. A composition as claimed in claim 1 wherein component (ii) used in forming said composition consists essentially of a mixture of polyethylene polyamines having an overall average composition approximating that of polyethylene tetramine.

7. A composition as claimed in claim 6 wherein said mixture of polyethylene polyamines is further characterized by containing on a weight basis:

a) at least 5% linear acyclic polyethylene polyamines;
b) at least 10% branched acyclic polyethylene polyamines; and
c) at least 60% cyclic polyethylene polyamines.

8. A composition as claimed in claim 6 wherein said mixture of polyethylene polyamines is further characterized by containing on a weight basis:

a) at least 30% of the isomer depicted as

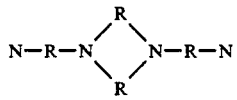

b) at least 20% of the isomer depicted as

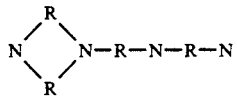

c) at least 10% of the isomer depicted as

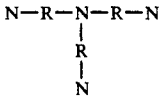

and d) at least 5% of the isomer depicted as wherein in each depiction hereof R is an ethylene group.

9. A composition as claimed in claim 4 wherein said component (i) used in forming said composition consists essentially of (a) at least one polyisobutenyl substituted succinic acid or (b) at least one polyisobutenyl substituted succinic anhydride or (c) a combination of at least one polyisobutenyl substituted succinic acid and at least one polyisobutenyl substituted succinic anhydride in which the polyisobutenyl substituent in (a), (b) or (c) is derived from polyisobutene having a number average molecular weight in the range of 700 to 5,000.

10. A composition as claimed in claim 4 further characterized in that such composition is post-treated by reaction with at least one post-treating reagent selected from the group consisting of boron oxide, boron oxide hydrate, boron halides, boron acids, esters of boron acids, carbon disulphide, hydrogen sulphide, sulphur, sulphur chloride, alkenyl cyanides, carboxylic acid acylating agents, aldehyde, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulphides, phosphorus oxides, phosphoric acid, phosphorous acid, hydrocarbyl thiocyanates, hydrocarbyl isocyanates, hydrocarbyl isothiocyanates, epoxides, episulphides, formaldehyde or formaldehyde producing compounds plus phenols, and sulphur plus phenols.

11. A composition as claimed in claim 1 further characterized in that such composition is post-treated by reaction concurrently or sequentially with at least one phosphorus-containing post-treating reagent and at least one boron-containing post-treating reagent such that the product is both phosphorylated and boronated.

12. A composition as claimed in claim 1 further characterized in that such composition is post-treated by reaction with at least one carboxylic acid acylating agent such that the product is acylated thereby.

13. A lubricant or functional fluid composition which comprises a major amount of at least one oil of lubricating viscosity and a minor dispersant amount of a dispersant composition as claimed in claim 1.

14. An additive concentrate composition which contains a dispersant composition as claimed in claim 1.

15. A method of lubricating mechanical parts with a lubricating oil containing a dispersant, the lubrication being conducted in the presence of at least one fluoroelastomer surface, said method characterized in that the lubrication is performed with a lubricating oil containing an oil-soluble dispersant as claimed in claim 1.

16. A lubricant or functional fluid composition which comprises a major amount of at least one oil of lubricating viscosity and a minor dispersant amount of a dispersant composition as claimed in claim 4.

17. An additive concentrate composition which contains a dispersant composition as claimed in claim 4.

18. A lubricant or functional fluid composition which comprises a major amount of at least one oil of lubricating viscosity and a minor dispersant amount of a dispersant composition as claimed in claim 11.

19. An additive concentrate composition which contains a dispersant composition as claimed in claim 11.

20. Apparatus comprising a mechanical mechanism having (a) moving parts to be lubricated, (b) a lubricating oil composition for lubricating said moving parts, and (c) at least one fluoroelastomer surface with which said lubricating oil composition comes in contact, said lubricating oil composition for effecting such lubrication containing an oil-soluble dispersant composition as claimed in claim 1.

21. Apparatus comprising a mechanical mechanism having (a) moving parts to be lubricated, (b) a lubricating oil composition for lubricating said moving parts, and (c) at least one fluoroelastomer surface with which said lubricating oil composition comes in contact, said lubricating oil composition for effecting such lubrication containing an oil-soluble dispersant composition as claimed in claim 4.

22. Apparatus comprising a mechanical mechanism having (a) moving parts to be lubricated, (b) a lubricating oil composition for lubricating said moving parts, and (c) at least one fluoroelastomer surface with which said lubricating oil composition comes in contact, said lubricating oil composition for effecting such lubrication containing an oil-soluble dispersant composition as claimed in claim 11.

* * * * *